US005098002A

United States Patent [19]

Hänsch et al.

[11] Patent Number: 5,098,002

[45] Date of Patent: Mar. 24, 1992

[54] STAPLING APPARATUS

[75] Inventors: Egon Hänsch, Wetzikon; Erwin Müller, Oberdurnten, both of Switzerland

[73] Assignee: Ferag AG, Hinwil, Switzerland

[21] Appl. No.: 528,735

[22] Filed: May 23, 1990

[30] Foreign Application Priority Data

May 25, 1989 [CH] Switzerland ..... 01963

[51] Int. Cl.[5] ..... B27F 7/28

[52] U.S. Cl. ..... 227/90; 227/88; 227/82

[58] Field of Search ..... 227/90, 113, 85, 87, 227/114, 117, 118, 82, 84, 88, 156, 81

[56] References Cited

U.S. PATENT DOCUMENTS

| | | | |
|---|---|---|---|
| 1,107,248 | 8/1914 | Bates et al. | 227/118 |
| 1,111,114 | 9/1914 | Weber | 227/87 |
| 1,644,192 | 10/1927 | Kast . | |
| 2,717,383 | 9/1955 | Stobb . | |
| 3,285,489 | 11/1966 | Lingle | 227/113 |
| 3,762,662 | 10/1973 | Noren . | |
| 4,315,588 | 2/1982 | Faltin . | |
| 4,335,841 | 6/1982 | Fogarasy . | |
| 4,471,897 | 9/1984 | Genyk et al. | 227/87 |

FOREIGN PATENT DOCUMENTS

| | | |
|---|---|---|
| 38215 | 1/1887 | Fed. Rep. of Germany . |
| 955225 | 1/1957 | Fed. Rep. of Germany . |
| 519993 | 4/1972 | Switzerland . |
| 549443 | 5/1974 | Switzerland . |
| 586595 | 4/1977 | Switzerland . |
| 662987 | 11/1987 | Switzerland . |
| 640073 | 7/1950 | United Kingdom . |

*Primary Examiner*—Frank T. Yost
*Assistant Examiner*—Allan M. Schrock
*Attorney, Agent, or Firm*—Willian Brinks Olds Hofer Gilson & Lione

[57] ABSTRACT

A stapling apparatus is provided. The stapling apparatus includes a shaft which is swivelably mounted on a supporting part of a stapling head. The stamp is seated rotationally firmly on the shaft. For the purpose of accepting a wire section from a wire section dispenser, the shaft can be swiveled clockwise by 180° from its staple placing position. The wire section accepted by the stamp is formed into a staple on a slotted link. The lateral arms of the staple are guided in grooves of the stamp arms. In the staple placing position, the staple is ejected from the stamp by means of a ram.

19 Claims, 8 Drawing Sheets

STAPLING APPARATUS

BACKGROUND OF THE INVENTION

The present invention relates to a stapling apparatus for stapling multi-sheet printed products of the type having a stamp movably mounted on a shaft, a matrix which bends an essentially straight wire section, and a ram for ejecting the staple.

A stapling apparatus of this type is known, for example, from GB Patent Specification 640,073. The stapling apparatus disclosed in this reference has a cube-shaped matrix, whose front side is beveled. Sunk into the matrix from the front side is a slot extending in an approximately horizontal direction, into which a section of a wire drawn from a roll can be inserted from the side. A stamp cooperating with the matrix is swivelably mounted via a lever to a shaft which extends horizontally. The stamp has two lateral bending sides, which, when the stamp swivels from an upper rest position into a lower staple placing position, bends over downwards the two arms which project laterally over the matrix, of the wire section which has been severed from the wire by means of a cutting blade fastened to the stamp. By means of a ram slidably mounted on the stamp, the staple thus formed, which is guided with the downwardly bent lateral arms in grooves in the bending sides, is pushed out of the stamp and through the printed sheets to be stapled. In the process, the ram slides along the beveled front side of the matrix, and pushes the latter to release the staple, caught in the slot, from the region of the grooves. This known stapling apparatus is conceived as a unit that is operated by hand and independent of other processing stations. This stapling apparatus has the disadvantage that it cannot be matched to different conditions, something which is also prevented by the feeding and severing of the wire, which takes place in a very small space, and the forming and ejection of the staples.

Further stapling apparatuses, which operate in a very similar way, are disclosed in the DE Patent Specifications 955,225 and 38,215 and in the EP-OS 0,013,165 and corresponding U.S. Pat. No. 4,335,841. In these apparatuses, the wire is fed to the matrix or to a holding part arranged on the matrix, and then a wire section is severed. The severed wire section is bent to form a staple by means of a swivelably or slidably mounted stamp which includes lateral bending sides that run past the matrix. The staple is then pushed from the matrix by means of a ram and inserted into the printed sheets.

A further stapling apparatus is known from CH Patent Specification 549,443. A stamp and a ram are slidably guided on a supporting part of a stapling head of this stapling apparatus. To place a staple, the stapling head is moved with the print products that are to be stapled and are deposited onto a collector chain. Subsequently the stapling head is brought back once again, against the conveying direction of the collector chain, into the original position. During this to and from movement, the stapling head runs along a stationary rest plate with two cam paths. One cam path slides the stamp from a rest position which is spaced from the collector chain into the staple placing position, and back again. The other cam path actuates the ram to eject the staple from the stamp, which is located per se in the staple placing position, and simultaneously to place the staple in the print products. Furthermore, a matrix is swivelably mounted on the supporting part in such a way that when the ram is lowered the matrix is swiveled by the ram from the region of a cutout in the stamp and from the region of the ram. A lever which is pretensioned against the matrix is swivelably mounted on the matrix. By means of a wire conveyor, which is likewise mounted on the supporting part and actuated by the ram, the advancing section of a wire is pushed in between the matrix and the lever in a direction perpendicular to the sliding direction of the stamp and of the ram. When the stamp is lowered from the rest position into the staple packing position, the first step is for the stamp to actuate a cutting arrangement that separates the wire section held by the lever and the matrix from the rest of the wire. Subsequently the wire section is bent around the matrix to form a staple. During subsequent lowering of the ram, an eyelet is first bent on the staple. During further lowering of the ram, in conjunction with simultaneous swiveling of the matrix out from the region of the ram and releasing of the lever from the wire section, the staple is ejected from the stamp and forced through the print products. Benders, which bend over the ends of the staple that are pushed through the print products, are provided on the collector chain. In this known stapling apparatus, the cutting to length of the wire, the forming of the staple from the severed wire section, and the placing of the staple take place in a very small space. This leads to a very compact, but also very complicated construction o the stapling head.

Further stapling apparatuses based on the same principle are known from Swiss Patent Specifications 519,933, 586,595 and 662,987.

Furthermore, rotary stapling apparatuses, in which the stapling head is arranged eccentrically on a rotating support disk in each case, are known from U.S. Pat. No. 2,717,383 or the corresponding DE-AS 1,055,499 and U.S. Pat. No. 3,762,622. In the course of a rotation, the stapling head runs past a wire section dispenser, from which the stamp, projecting approximately in the radial direction accepts a wire section. In the course of the further rotation, the grasped wire section is moved along a fixed matrix which is shaped like a slotted link. The matrix bends the wire section to form a staple. As soon as the stapling head reaches the print products, which are conveyed at approximately the rate of rotation of the stapling head tangential to the rotation track of the stapling head, the staple is forced out of the stamp and through the print products by means of a ram. The free ends of the staple are bent by means of a bending head, which likewise rotates. While the staple is being placed, the stapling head experiences small correcting swiveling movements in order to match the stamp to the rate and the direction of movement of the print products.

Therefore, it is an object of the present invention to create a stapling apparatus according to the generic type described above with a simple design, which can be universally employed.

SUMMARY OF THE INVENTION

To achieve these objects a stapling apparatus for stapling multi-sheet print products is provided which comprises a stapling head having a supporting part and a shaft mounted on the supporting part. The apparatus also includes a stamp movably mounted on the shaft such that the stamp is moveable from a rest position into a staple placing position and back again. A matrix comprising a slotted link for bending an essentially straight wire section, which extends approximately parallel to the axis of the shaft is provided. A stamp forces the wire section against the matrix to form a staple. A ram ejects the staple from the stamp when the stamp is located in the staple placing position. The stamp is configured such that a wire section from a wire section dispenser is accepted by the stamp in a wire acceptance position, the wire acceptance position being spaced from the staple placing position. The stamp is further configured such that the stamp can be moved along the matrix to bend the wire section. The matrix is arranged such that the spacing between the matrix and the axis of the shaft decreases.

With this arrangement the preparation of the wire, the bending of a staple from the wire section, and the ejection of the staple from the stamp are spatially separated from one another. This provides space for a simple design of the stapling apparatus, without the need to enlarge the dimensions of the stapling apparatus by comparison with known stapling apparatuses. The wire sections are accepted by a wire section dispenser which does not need to be arranged on the stapling head. This enables the feeding of a plurality of stapling heads by means of a single wire section dispenser. This arrangement allows a simple construction, especially for stapling apparatuses with a plurality of stapling heads.

BRIEF DESCRIPTION OF THE DRAWINGS

The invention will now be described in more detail with reference to two embodiments of the stapling apparatus represented in the drawing, wherein. purely diagrammatically:

FIGS. 1 and 2 show in side view and top view respectively, a first embodiment of a stapling head.

DETAILED DESCRIPTION OF THE PRESENTLY PREFERRED EMBODIMENTS

Figure 2:
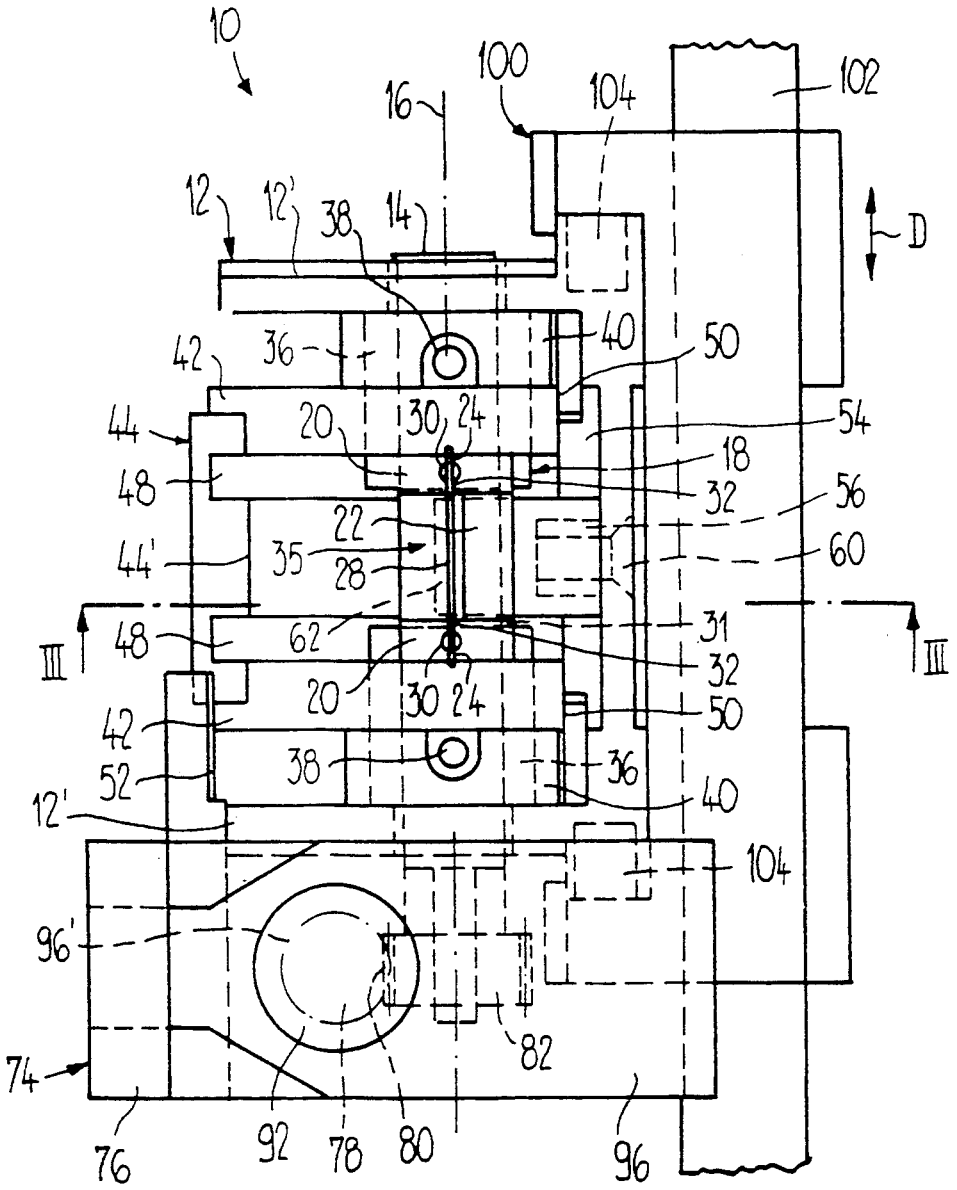
Figure 3:
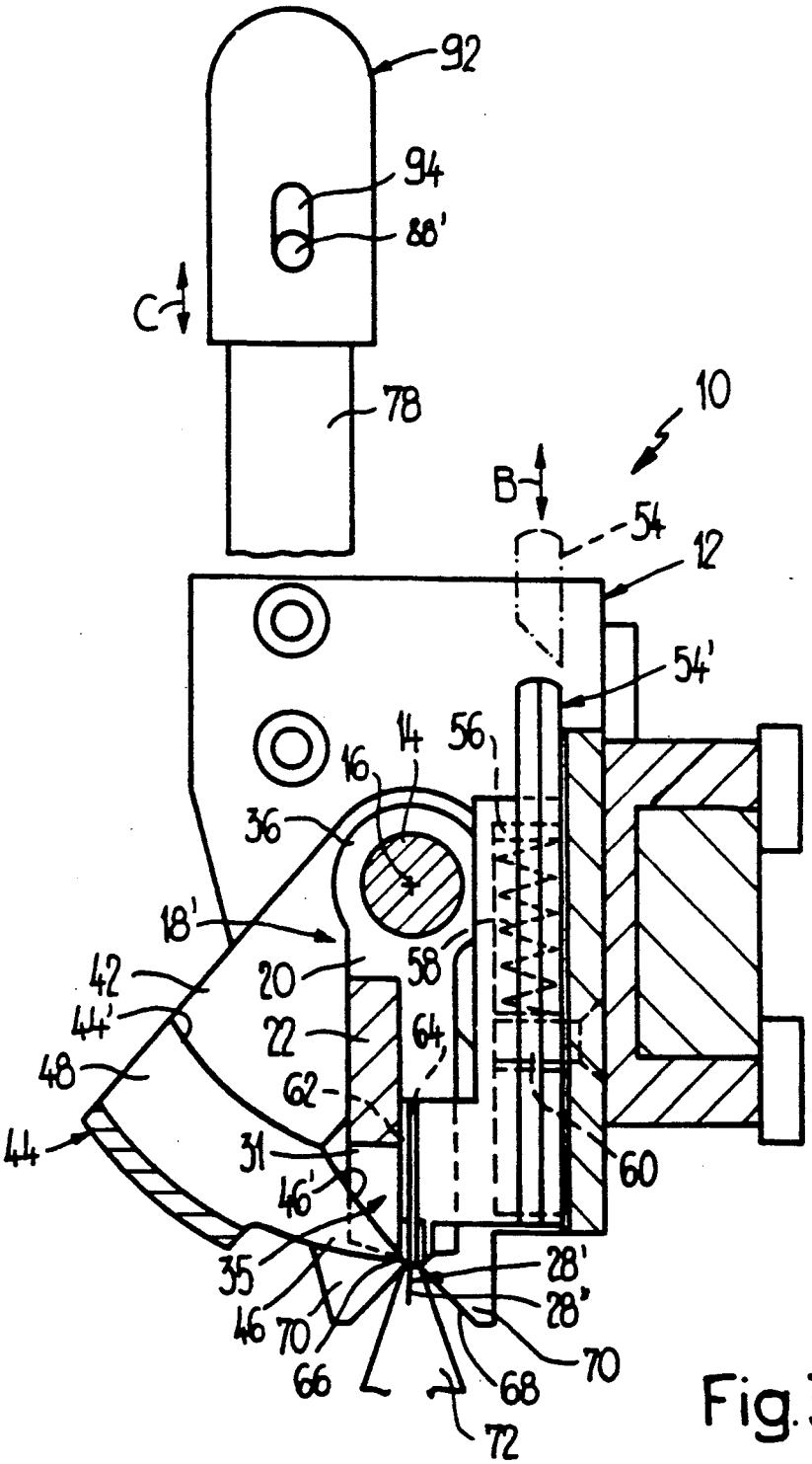
FIG. 3 shows the same stapling head along the line III—III of FIG. 2, partly cut away.

The stapling head 10 shown in FIGS. 1 to 3 has a supporting part 12 which is essentially U-shaped in cross-section. The supporting part 12 includes lateral sides 12 on which a shaft 14 is pivotally mounted. The swivel axis of the shaft 14 is indicated with dots and dashes and designated by 16. Seated rotationally firmly on the shaft 14 is a stamp 18. The stamp 18 includes two mutually parallel stamp arms 20 which are mutually spaced in the axial direction and which are connected to one another by means of a lateral web 22. The stamp 18 is shown in its rest position in FIGS. 1 and 2, and in the staple placing position 18', which is swiveled by 180°, in FIG. 3. At its free end, each stamp arm 20 has a drive nose 24, in order, upon passing by in the direction of the arrow A, to drive a wire section 28 from a wire section dispenser 26 which is illustrated diagrammatically. The wire section extends parallel to the swivel axis 16. Preferably a permanent magnet 30 is provided in the region of the drive nose 24 on each stamp arm 20, to hold the driven wire section 28 on the stamp 18.

In the region between the web 22 and the free ends, the two stamp arms 20 have mutually projecting swellings 31. Grooves 32, which extend in the radial direction and are open with respect to one another, are arranged in the swellings 31. The grooves 32 in the case of the wire section 28 are open outwards, seen in the radial direction. During movement of the stapling head 10 in the direction of the arrow A, the wire section 28 is bent to form a staple 28' by means of a slotted link 34 (FIG. 1), which is indicated diagrammatically and whose spacing from the shaft 14 in the direction perpendicular to the direction of the arrow A decreases. The stamp as illustrated is located in the rest position. The staple now comes to rest in the cutout 35 in the stamp 18. The cutout is bounded by the two stamp arms 20 and the web 22, the lateral arms 28'' of the staple 28' being guided in the particular grooves 32 (cf. FIG. 5).

Each stamp arm 20 is arranged rotationally firmly on a bush 36, which is seated on the shaft 14 and is connected rotationally firmly therewith by means of a bolt 38. In the region between the stamp arm 20 and the relevant side 12' of the supporting part 12, facing this side 12', a spacer bush 40 is arranged on each bush 36, and a pivoted lever 42 is mounted freely pivotally between the spacer bush 40 and the stamp arm 20. A staple guide element 44, constructed in the form of an annular segment, is provided in the free end region on the two pivoted levers 42. Seen counterclockwise (FIGS. 1 and 3), the staple guide element 44 has a staple guide nose 46 which projects over the pivoted lever 42. The pivoted lever 42 tapers outwards in the form of a wedge in the direction against its end. The wedge face facing the shaft 14 is designated by 46'. Provided on the staple guide element 44 are two grooves 48, which are open inwards in the radial direction and in which the free end regions of the staple arms 20 engage when the stamp 18 is swiveled. In this process, the region of the staple guide element 44 between the two grooves 48, which is designated by 44', engages in the cutout 35 in the stamp 18.

Nose-shaped stops 50, which cooperate with the supporting part 12 and define the rest position of the staple guide elements shown in FIG. 1, are integrally formed on the pivoted levers 42 in the region of the shaft 14. A leaf spring arrangement 52 is arranged on the supporting part 12. By means of the leaf spring arrangement 52 the staple guide element 44 is held in its rest position prestressed counterclockwise, with the leaf spring arrangement 52 acting upon one pivoted lever 42. In this rest position, the staple guide nose 46 engages in the cutout of the stamp 18, which is located in the staple placing position 18' (cf. also FIG. 6).

Furthermore, a ram 54 is slidably mounted in the direction of the arrow B on the supporting part 12. A groove-shaped cutout 56 extends in the direction B and is open towards the supporting 12. Arranged in this groove-shaped cutout 56 is a compression spring 58 which is supported at its upper end on the ram 54 and on its lower end on a bolt 60, which is fastened to the supporting part 12 and projects into the groove-shaped cutout 56. The upper end position of the ram 54, represented in FIG. 1 with unbroken lines and in FIG. 3 with dots and dashes is thus defined by the bolt 60 which is present at the lower end of the groove-shaped cutout 56. In its lower position 54', represented in FIG. 3 with unbroken lines, the ram 54 can be slid by means of a slotted member or link (not represented).

In its lower end region, the ram 54 has a ram head 62 on the side averted from the supporting part 12. The ram head 62 projects between the two stamp arms 20 when the stamp 18 is located in the staple placing position 18', and has a guide wedge 64 which is integrally formed on each of its sides. When the stamp 18 is located in the staple placing position 18', and when the ram 54 is forced in the direction against the lower end position 54', these guide wedges 64 slide into the grooves 32 in the stamp arms 20. On the lower end, the ram head 62 has a ram groove 66, by means of which the ram 54 comes to bear against the staple 28'.

At their lower ends, the two lateral sides 12' of the supporting part 12 have a V-shaped cutout 68, which narrows upwards and is bounded by two holding noses 70, in order to force the print products (not represented in these figures) against a support 72.

A drive arrangement 74 for the shaft 14 is arranged on one side 12' of the supporting part 12. The drive arrangement 74 has a block-shaped guide element 76, which is fastened to the side 12' and on which an actuating shaft 78 is slidably guided in the direction of the arrow C. A toothed rack 80 is integrally formed on the actuating shaft 78 at the lower end region. The toothed rack 80 meshes with a pinion 82 which is rotationally seated firmly on the shaft 14.

The actuating shaft 78 has a bore 84, which extends from below as far as into the upper end region, and in which a further compression spring 86 is inserted. This compression spring 86 is supported with its lower end on a pin 88. The pin 88 in turn is fastened to the guide element 76 and pushes the actuating shaft 78 through a passage 90 that is elongated in the direction C.

A further bore 84', in which a further compression spring 86' is arranged, is provided from above in the actuating shaft 78. A capshaped sliding shoe 92, on which the upper end of the compression spring 86' is supported, is pushed over the upper end region of the actuating shaft 78. A further pin 88'. is fastened to the actuating shaft 78. The further pin 88' pushes the sliding shoe 92 through in the region of a lateral elongated hole 94 and thus determines the range of movement of the sliding shoe 92 relative to the actuating shaft 78.

Furthermore, a clamp lever 96 having a hole 96', which is of slightly larger diameter than the actuating shaft 78 and through which the actuating shaft 78 is guided, is swivelably mounted on the guide element 76. The clamp lever 96 is pretensioned counterclockwise by means of a compression spring 98. The compression spring 98 is supported on the guide element 76, such that the clamp lever 96 clamps the actuating shaft 78 in place against the force of the compression spring 86 by tilting. This clamping effect is undone by swiveling the clamp lever 96 clockwise.

The entire supporting part 12 is slidably mounted in the direction of the arrow B in a bearing arrangement 100, which is fastened to a support section 102. Provided on the supporting part 12 are lateral, groove-shaped cutouts 104 into which a bolt 106, which is fastened to the bearing arrangement 100, projects in each case. Moreover, in each case the supporting part 12 has a bore 108, which opens from below into the groove-shaped cutout 104 and carries a thread (FIG. 1). A screw 110, on which the lower end of a further compression spring 112, which stands on the bolt 106 at its upper end, is supported, is screwed into said bore. Consequently the supporting part 12 is forced by means of the compression spring 112 with the upper end of the groove-shaped cutout 104 against the bolt 106 into its lower end position, represented in FIGS. 1 to 3. For the purpose of stapling the entire stapling head 10 is slid downwards by lowering the support section 102 in the direction of the arrow B. In this process, the compression spring 112 accommodates the differing thickness of the print products to be stapled. The bearing arrangement 100 is detachably fastened to the support section 102 in order to slide the stapling head 10 in the direction of the arrow D (FIG. 2), and arrange it at the desired position on the support section 102, in order to be able to undertake stapling at the preferred location.

Furthermore, FIG. 1 indicates with dashes an embodiment in which the slotted link 34 is replaced by a slotted link 34'. The slotted link 34' is arranged on the staple guide element 44 and projects from the latter on the side averted from the staple guide nose 46. Upon swiveling of the stamp 18, which holds a wire section 28, from the rest position into the staple placing position 18', the wire running up onto the slotted link 34' is bent, in conjunction with simultaneous insertion into the grooves 32 extending in the radial direction, to form a staple 28'.

The stapling head 10 is represented in greatly simplified form in FIGS. 4 to 9 in a vertical section along the swivel axis 16 in different phases of a stapling process. The bushes 36 with the stamp arms 20, fastened thereupon, of the stamp 18 are seated rotationally firmly on the shaft 14. The web 22 between the two stamp arms 20 is represented, and the mutually open grooves 32 are shown in the end region of the stamp arms 20. The pivoted levers 42 are pivotally mounted on the bushes 36. Likewise represented is the ram 54 with its ram head 62, shown below the shaft 14, with the lateral guide wedges 64.

Figure 4:
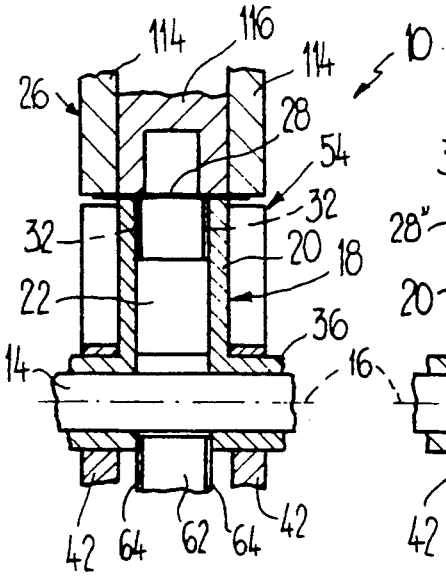
FIGS. 4 to 9 show the stapling head, represented simplified form, in different phases of an operational cycle.

Likewise shown in FIG. 4 is the wire section dispenser 26. This has two support disks 114, which are driven to rotate about an axis (not represented) extending parallel to the swivel axis 16. Mounts 116 are provided behind one another in the circumferential direction between the two support disks 114 for one wire section 28 in each case. Each mount 116 has a permanent magnet (not represented), in order to hold the wire section 28 on the mount 116.

Figure 5:
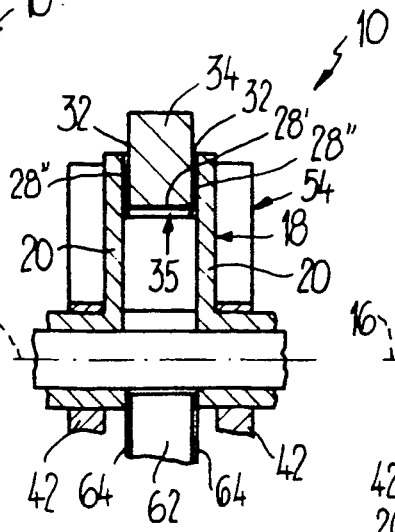

Represented in FIG. 5 is the slotted link 34 by means of which the wire section 28 is bent to form a staple and inserted with the lateral arms 28'' into the grooves 32.

Figure 6:
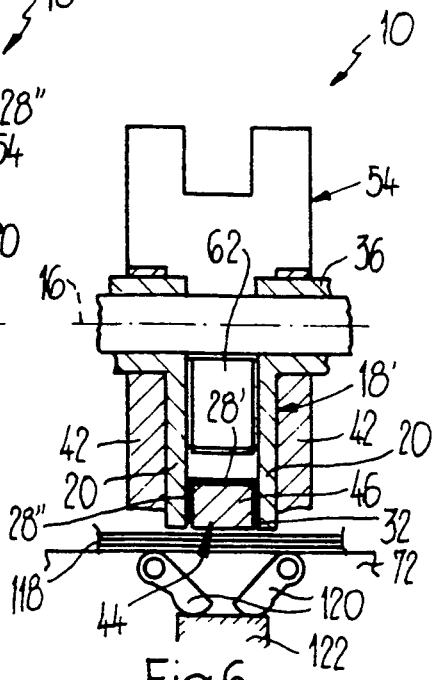

In FIG. 6, the stamp 18 is located in the staple placing position 18', the staple guide nose 46 of the staple guide element 44 engaging in the cutout between the stamp arms 20 and thereby preventing the two arms 28'' of the staple 28' from being able to slide out of the grooves 32. A number of printed sheets 118 stacked one above the other are located on the support 72. Swivelably mounted in the support 72 are two benders 120 which can be brought by means of a raisable and lowerable bend-over ram 122 from the lower swivel position shown in FIGS. 6 and 7 into an upper swivel position shown in FIG. 8, and back again. Furthermore, ram actuating slotted links 124 are represented in section in FIGS. 7 and 8.

The stapling head represented in FIGS. 1 to 9 operates as follows. Initially, the stamp 20 is located in the rest position represented in FIGS. 1, 2, 4 and 5, and the ram 54 is located in its upper end position represented in the same figures. When passing by the stapling head 10 from the wire section dispenser 26 in the direction of the arrow A, the drive noses 24 detach the wire section 28 from the mount 116 and drive said wire section along the wire section 28 being held on the radial ends of the stamp arms 20 by means of the permanent magnets 30. In the course of sliding of the stapling head 10 along the slotted link 34 (matrix), whose spacing from the shaft 14 decreases during this sliding, the wire section 28 is bent over to form a staple 28'. The lateral arms 28" of the staple 28' are inserted into the grooves 32 in the stamp arms 20; the width of the slotted link 34 being approximately the clearance between the two arms 28" (FIG. 5).

Figure 7:
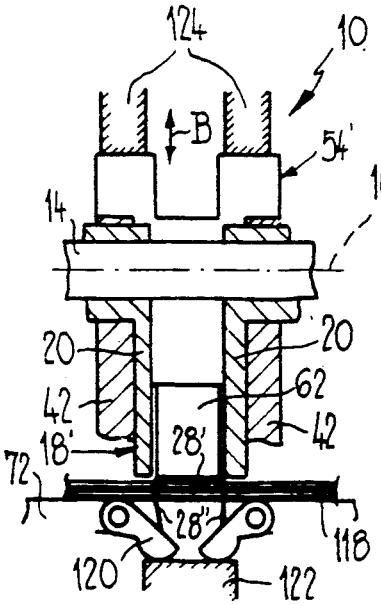
Figure 8:
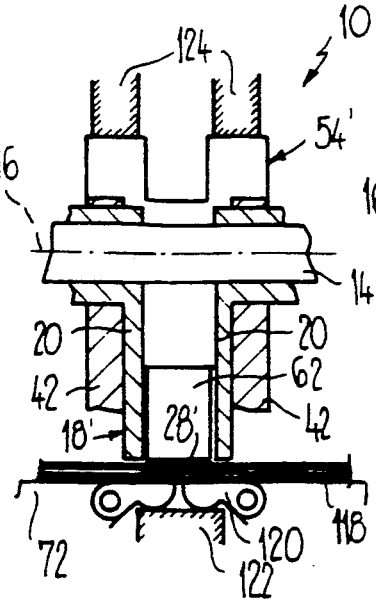

The shaft 14, and thus the stamp 18, is swiveled counterclockwise by 180° into the staple placing position 18' by a force directed downwards in the direction of the arrow C onto the sliding shoe 92, for example likewise by means of a slotted link (in this connection see FIG. 6). In the course of this swiveling movement, the free ends of the stamp arms 20 engage in the grooves 48 of the staple guide element 44, so that the arms 28" of the staple 28' are now held in the grooves 32. To place the staple 28', the stapling head 10 is brought to bear against the printed sheets 118 to be stapled by being lowered onto the support section 102. The running up of the ram 54 onto the ram actuating slotted link 124 moves the ram 54 downwards in the direction of the arrow, such that said ram slides with its guide wedges 64 into the grooves 32 of the stamp arms 20, and ejects the staple 28' from the stamp with the ram groove 66. In this process, the arms 28" pierce the printed sheets 118, as is represented in FIG. 7. When the ram 54 is brought from its upper into the lower end position 54', the ram head 62 presses with its lower end against the wedge face 46' of the staple guide nose 46. In this process, the pivoted levers 42 together with the staple guide element 44 are swiveled clockwise by the ram 54 against the force of the leaf spring arrangement 52. The part of the arms 28" located between the printed sheets 118 and the ram groove 66 is thus held in the grooves 32 by the staple guide element 44 during the entire process of placing the staple 28'. The benders 120 are swiveled into their upper end position by subsequently raising the bend-over ram 122. This results in bending the arms 28' which projects underneath the printed sheets 118 against one another (FIG. 8).

Figure 9:
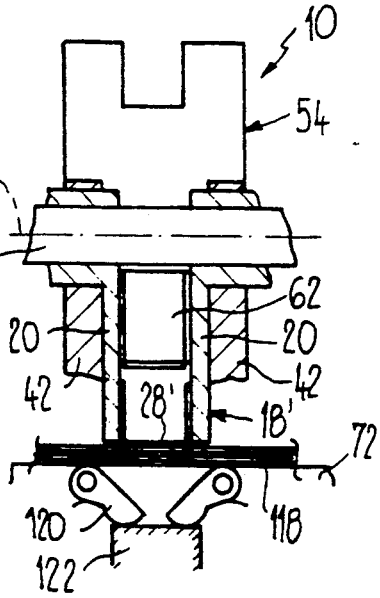

By returning the ram 54 from the ram actuating slotted link 124, the ram 54 is pushed into the upper end position once again by the compression spring 58. Consequently, the guide wedges 64 once again come out of engagement with the grooves 32 (FIG. 9). As soon as the ram 54 once against moves back from its lower 54' into its upper end position, the pivoted levers 42 together with the staple guide element 44 are once again swiveled counterclockwise into their rest position, in which the stops 50 bear against the supporting part 12, by the leaf spring arrangement 52.

By exercising a force downwards onto the clamp lever 96 in the direction of the arrow B (cf. FIG. 1), the actuating shaft 78 held in its lower end position by the clamp lever 96 is now released, such that said shaft is once again brought into its upper rest position shown in FIG. 1 under the force of the compression spring 86. Consequently, the shaft 14 and thus the stamp 18 are once against swiveled back by 180°, this time clockwise, into the rest position. The stapling head 10 is now ready to staple anew. The last step is for the stapling head 10 to be raised from the stapled printed sheets 118.

When the support section 102 is lowered, the stapling head 10 is brought to bear against the printed sheets 118, the holding noses 70 pressing the printed sheets 118 on the support 72 on both sides of the staples 28' against the support 72. Consequently, seen in the direction of the swivel axis 16, the printed sheets are held behind and in front of the staple 28' and on both sides of the staple 28'. This arrangement leads to especially neat stapling.

In the case of the embodiment of a stapling head 10 represented in FIGS. 10 to 17, the drive arrangement 74, shown in FIGS. 1 and 2, for the shaft 14 is, for the sake of simplicity, no longer represented. In these FIGS. 10 to 17, parts operating in the same way as in the case of the stapling head 10 in accordance with FIGS. 1 to 9 are designated by the same reference numerals.

Figure 10:
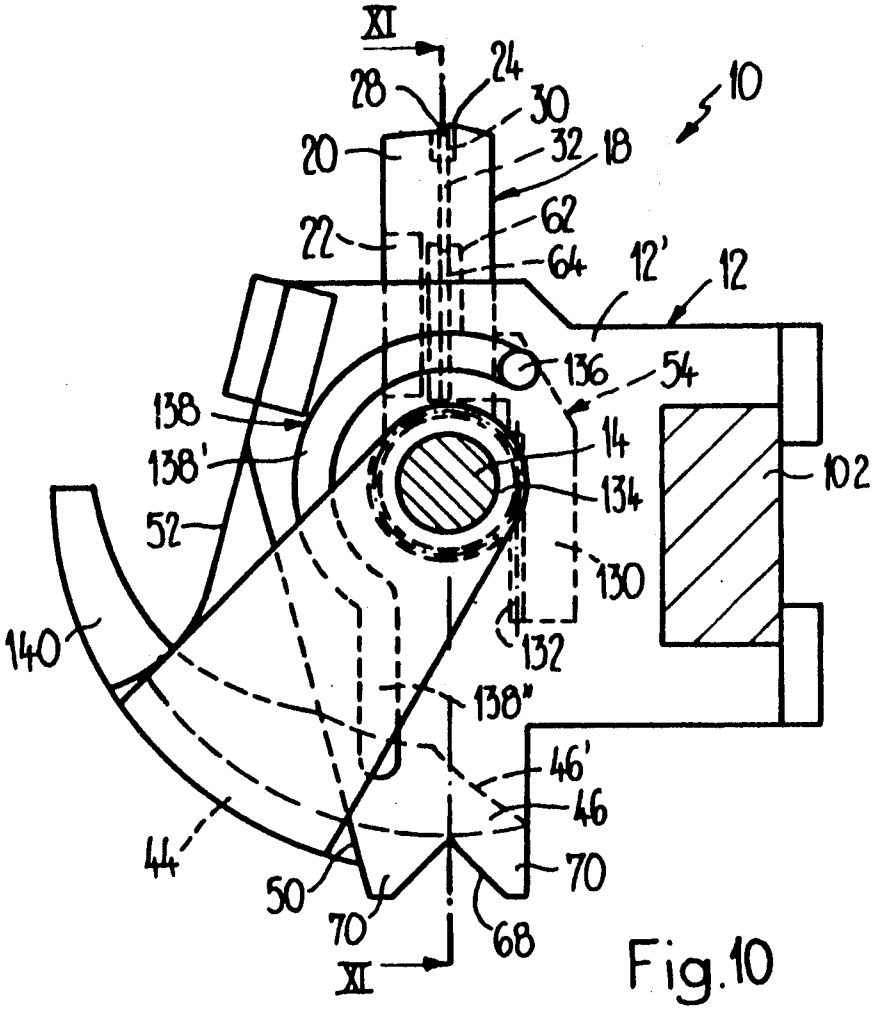
FIG. 10 shows in side view a further embodiment of a stapling head.

The stapling head 10 likewise has a supporting part 12 with a cross-section which is essentially U-shaped in horizontal section. The supporting part 12 is fastened to a support section 102. Once again, one bush 36 each is pivotally mounted on the lateral sides 12' of the supporting part 12. The shaft 14, which can be rotated freely in relation to the bushes 36, extends through the bushes 36. The swivel axis of the shaft 14 is represented with dots and dashes in FIG. 11, and designated by 16. The two stamp arms 20, which extend mutually parallel, of the stamp 18 are fastened to the relevant bushes 36 in the region between the two sides 12'. The two stamp arms 20 are connected to one another by the web 22 (FIG. 10). At the free end, each stamp arm 20 has a drive nose 24 and a permanent magnet 30 represented diagrammatically, which are of the same construction as in the stapling head 10 described in more detail above and represented in FIGS. 1 to 9. A wire section 28 is held by the permanent magnet 30 in the region of the drive nose 24.

Figure 11:
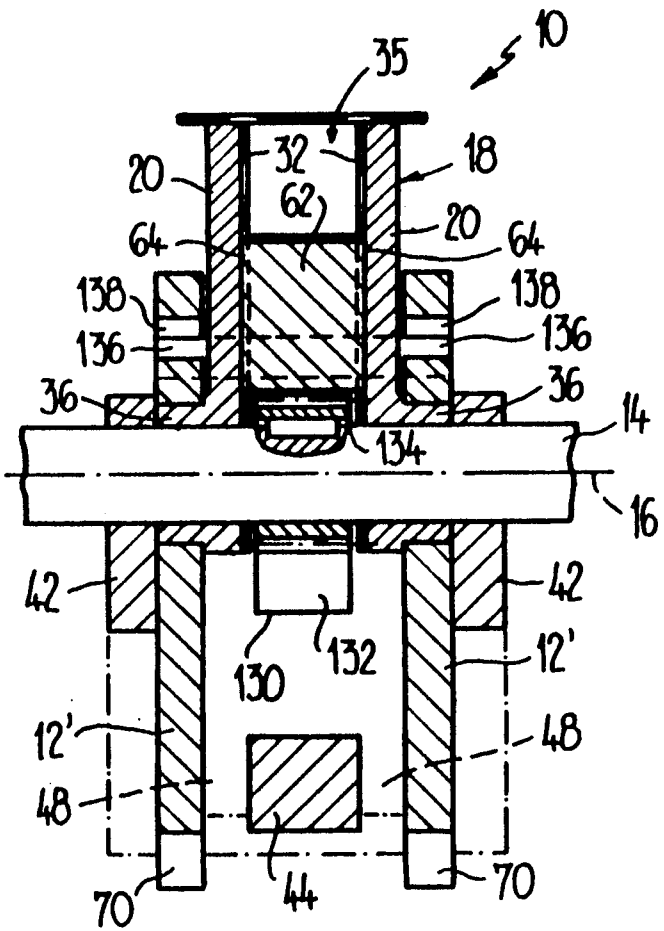
FIG. 11 shows a vertical section through the stapling head along the line XI—XI of FIG. 10.

The stamp arms 20 have mutually open grooves 32 that extend in the radial direction over the entire length of the stamp arms 20. The grooves 22 are open in the radial direction in the region of the wire section 28. The ram 54 is slidably guided in the radial direction in the stamp 18 by means of the guide wedges 64 arranged laterally on the ram head 62. Formed integrally on this ram head 62 is an approximately Z-shaped actuating part 130, on which a toothed rack 132 is constructed. The toothed rack 132 extends parallel to the longitudinal extent of the stamp arms 20 and meshes with a pinion 134 that is seated rotationally firmly on the shaft 14 and arranged between the two bushes 36. This pinion 134 is wedged in a known fashion onto the shaft 14, as is represented in FIG. 11. A guide bolt 136 is provided on the ram 54 in the extension of the toothed rack 132 in the direction against the ram head 62. The guide bolt 136 projects above the ram 54 on both sides, and is guided in each case in an identical control slotted link 138 in the sides 12' of the supporting part 12. From the rest position of the stamp 18 represented in FIGS. 10 and 11, the control slotted link 138 extends counterclockwise over an angle of 180° in a first section 138' concentric with the shaft 14. Subsequently, it has a section 138" departing from the shaft 14, which extends parallel to the grooves 32 of the stamp 18, which is located in its staple placing positions 18' (cf. FIG. 13).

Figure 13:
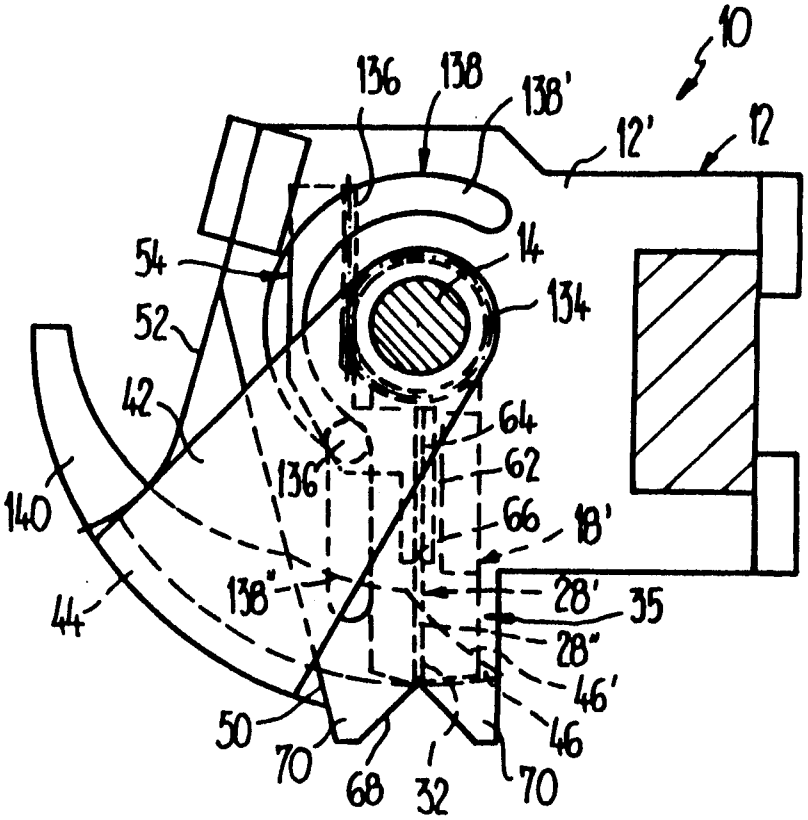
FIGS. 12 to 14 show the stapling head in three different phases of an operational cycle.

Two pivoted levers 42 are mounted freely pivotally on the shaft 14 outside the two sides 12'. At their free end regions, the two pivoted levers 42 are connected to one another by a staple guide element 44. The staple guide element 44 has a staple guide nose 46, which projects, seen counterclockwise, over the two pivoted levers 42 and engages in the cutout 35 bounded by the stamp arms 20, when the staple guide element 44 is located in the rest position and the stamp 18 is located in the staple placing position 18' (FIG. 13). A bending slotted link 140 (matrix) is integrally formed on the staple guide element 44 on the side averted from the staple guide nose 46. In the direction rotated counterclockwise by 90° relative to the rest position of the stamp 18, the spacing between the swivel axis 15 and the bending slotted link 140 is insignificantly larger than the spacing between the swivel axis 16 and the outer end, seen in the radial direction of the wire section 28 held on the staple arms 20. In an angular range, following counterclockwise, of approximately 60°, the spacing between the bending slotted link 140 and the pivoted axis 16 decreases and then merges into a concentric region of the staple guide element 44. The bending slotted link 140 and the staple guide element 44 have grooves 48, extending mutually parallel (see FIG. 11), in which the end regions of the two stamp arms 20 come to be located when the stamp 18 is swiveled against the staple placing position 18'. The staple guide element 44 tapers outwards in a wedge-shaped fashion in the radial direction in the region of the staple guide nose 46. The wedge face is designated by 46'. Fastened to one side 12' of the supporting part 12 is a leaf spring arrangement 52, which acts upon one pivoted lever 42, and forces the pivoted levers 42 together with the guide element 44 and the bending slotted link 140 counterclockwise with the stops 50 integrally formed thereon against the supporting part 12.

When the stamp 18 is located in the staple placing position 18' (FIG. 13), the two sides 12' project over the free end of the stamp 18, and have a V-shaped cutout 68 directed radially inwards, which is bounded by two holding noses 70.

Figure 12:
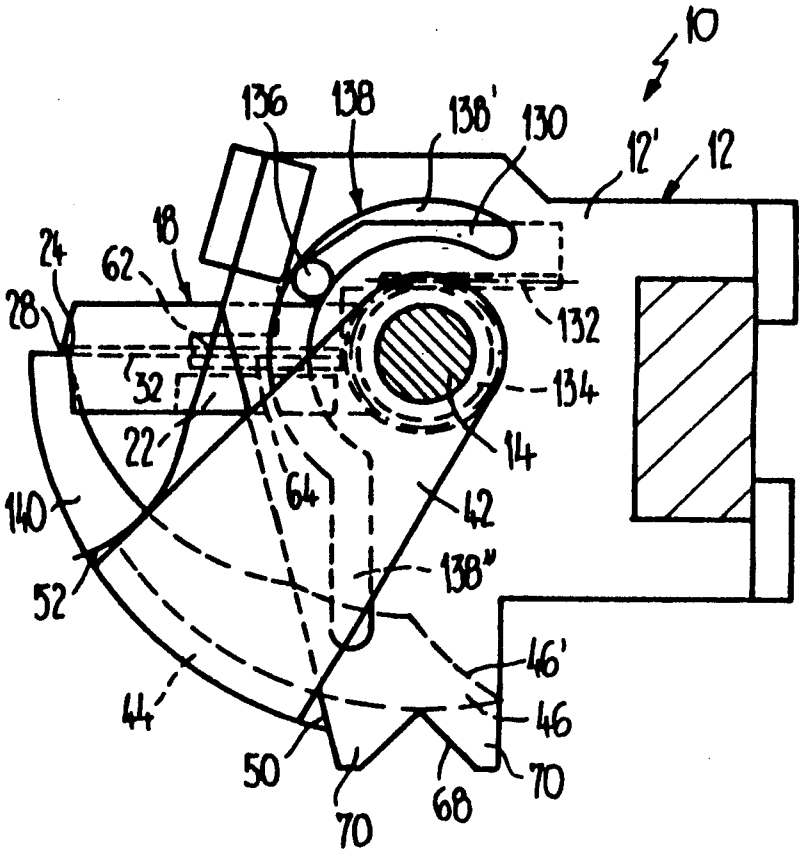
Figure 14:
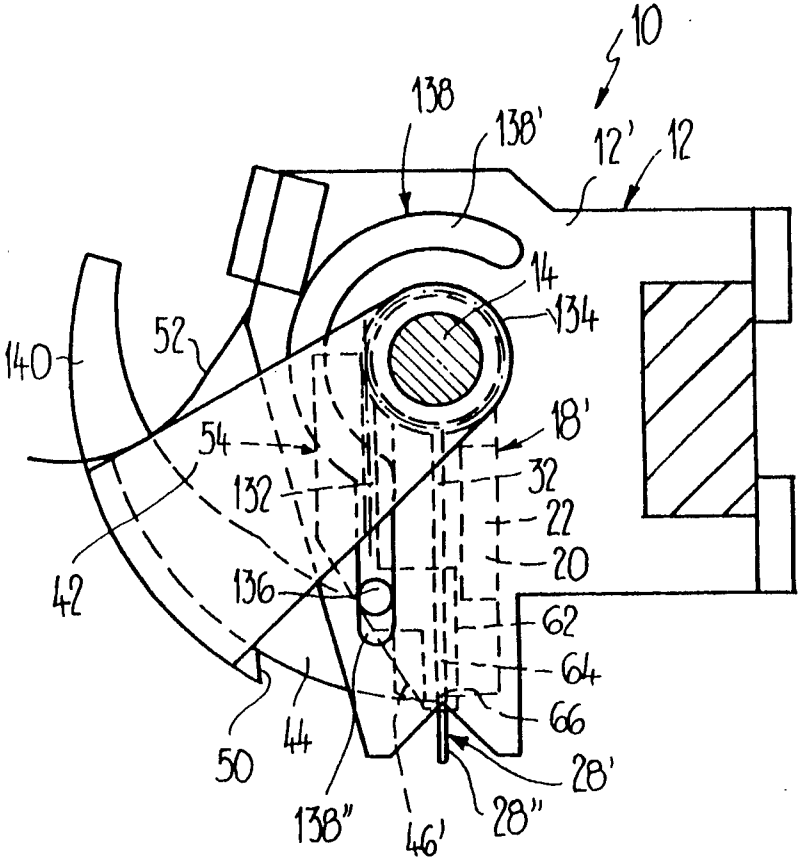

In FIGS. 10 and 11, the stamp 18 is located in its rest position. The stamp 18 is represented in FIG. 12 swiveled counterclockwise by 90° relative to its rest position, and in FIGS. 13 and 14 it is located in the staple placing position 18'. In FIG. 14, the ram 54 is shown in the region of its lower end position, in which the staple 28' is ejected from the stamp 18.

The mode of operation of the stapling head 10 will now be represented with reference to FIGS. 10 to 14. In the same manner as was explained in connection with FIGS. 1 to 3, in its position represented in FIGS. 10 and 11 the stamp 18 accepts a wire section 28 from the wire section dispenser. Subsequently, the shaft is rotated counterclockwise. As long as the guide bolt 136 is located inside the section 138 of the control slotted link 138, the ram 54 cannot move in the radial direction, and therefore the stamp 18 is coupled rotationally firmly to the shaft 14 via the ram 54. Thus, after a counterclockwise rotation, the stamp 18 passes into the position shown in FIG. 12, in which the wire section 28 runs up onto the bending slotted link 140.

In the course of the further rotation of the stamp 18, the wire section 28 is bent to form a staple 28', whose arms 28'' are guided in the grooves 32 of the stamp arms 20. As soon as the stamp 18 has reached the staple placing position 18 shown in FIG. 13, the rotationally firm coupling between the shaft 14 and the stamp 18 is released as a result of the section 138'' of the control slotted link 138, which section now extends parallel to the stamp 18. Upon further counterclockwise rotation of the shaft 14, the pinion 134 rolls down the toothed rack 132, and this results in a movement of the ram 54 that is directed outwards in the radial direction. In this process, the ram groove 66 in the ram head 62 comes to bear against the staple 28', and pushes the latter in the radial direction out of the stamp 18. In this process, the ram head 62 comes to bear against the wedge face 46' of the staple guide nose 46, and swivels away the staple guide element 44 together with the pivoted levers 42 clockwise from the region of the ram 54 against the force of the leaf spring arrangement 52. During the ejection of the staple 28 from the stamp 18, the lateral arms 28'' of the staple 28' are held by the staple guide nose 46 in the grooves 32 of the staple arms 20 so that the staple 28' is guided during the entire ejection process.

After the placing of the staples 28', the shaft 14 is driven clockwise. In this process, as long as the ram 54 is located in the section 138'' of the control slotted link 138, it is drawn inwards in the radial direction, such that the staple guide element 44 swivels back counterclockwise into the rest position under the force of the leaf spring arrangement 52. Upon further rotation of the shaft 14, the stamp 18 swivels into its rest position.

Figure 15:
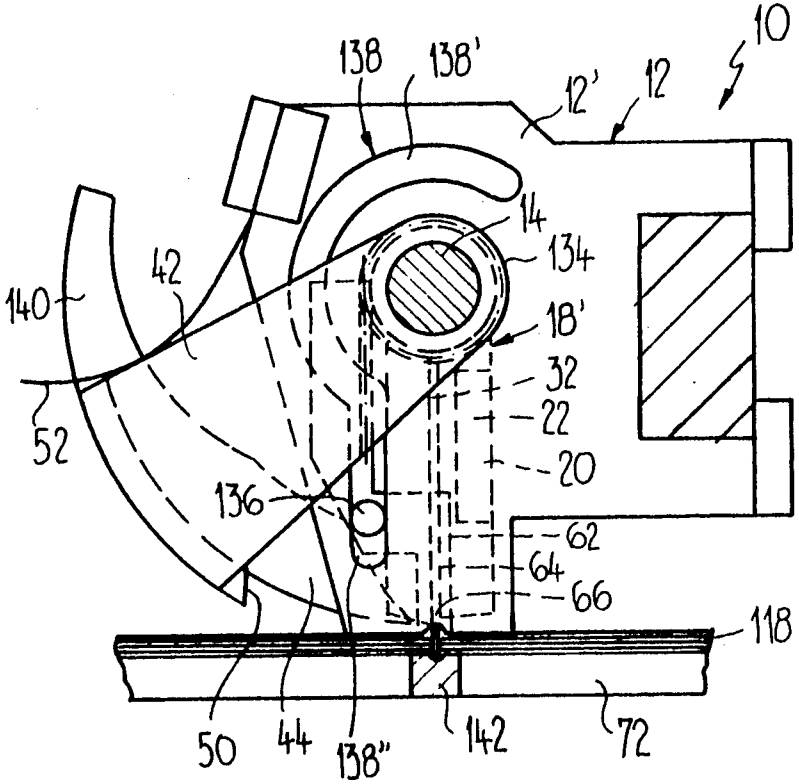
FIG. 15 shows the stapling head during placing of a staple in flat print products.
Figure 17:
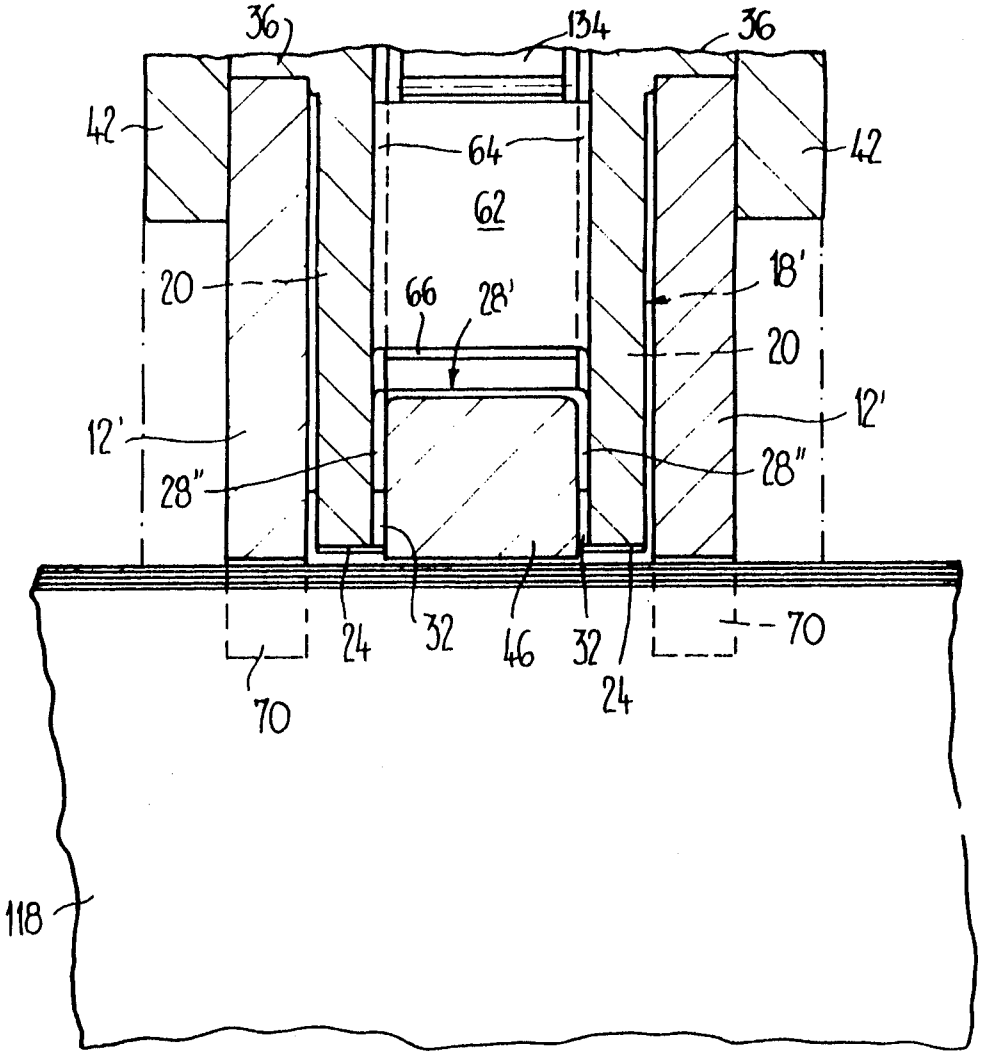
Figure 16:
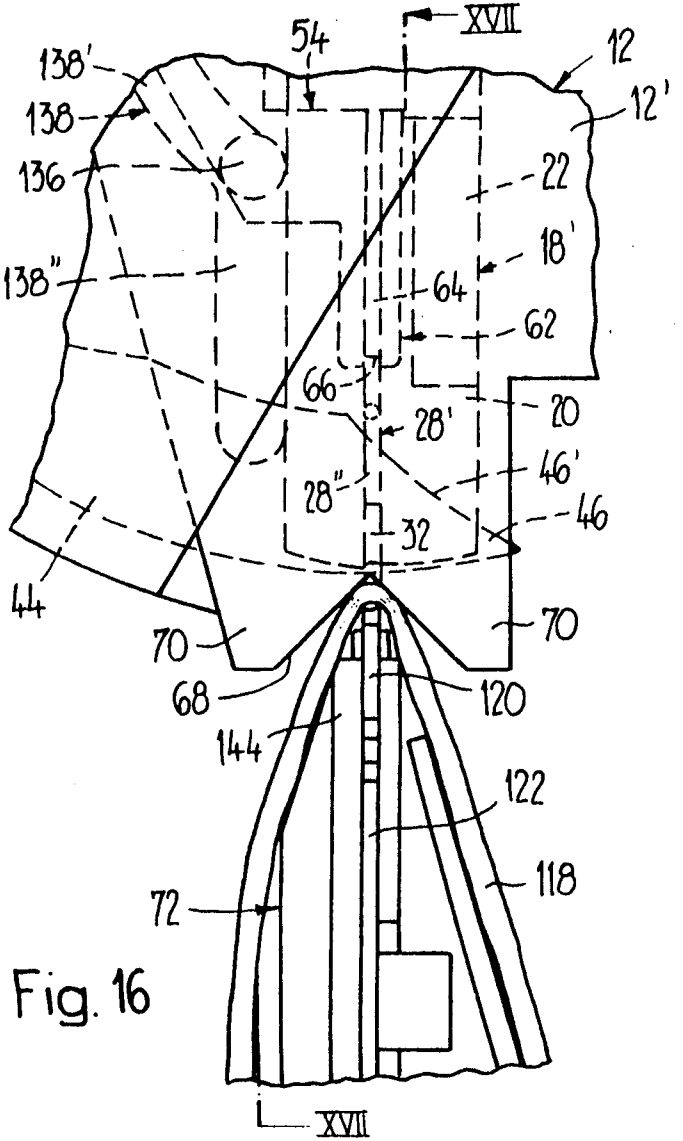

It is now shown in FIG. 15 how the staple 28' ejected in accordance with FIG. 14, is inserted into printed sheets 118 deposited onto a flat support 72. In this case, the holding noses 70 are constructed only very short, so that seen in the longitudinal direction of the staple 28' the printed sheets 118 are forced against the support 72 in front of and behind the staple 28' and on both sides of the staple 28'. On the side opposite the ram 54 relative to the printed sheets 118, the support 72 has a stationary, generally known bender arrangement 142, which bends over the sections of the arms 28'' projecting over the printed sheets 118.

Figure 17:
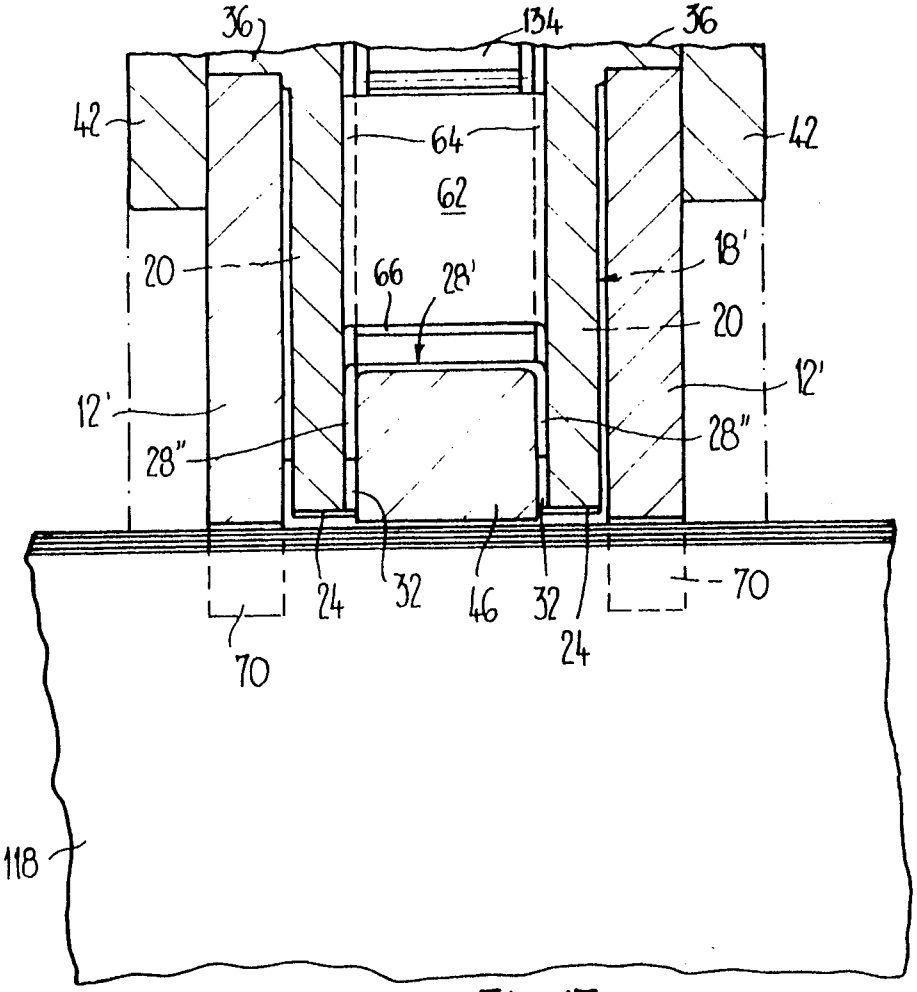
FIGS. 16 and 17 show in side view or in a section along the line XVII—XVII of FIG. 16, a part of the stapling head, represented enlarged, during placing of a staple in print products deposited astride a saddle-shaped support.
Figure 16:
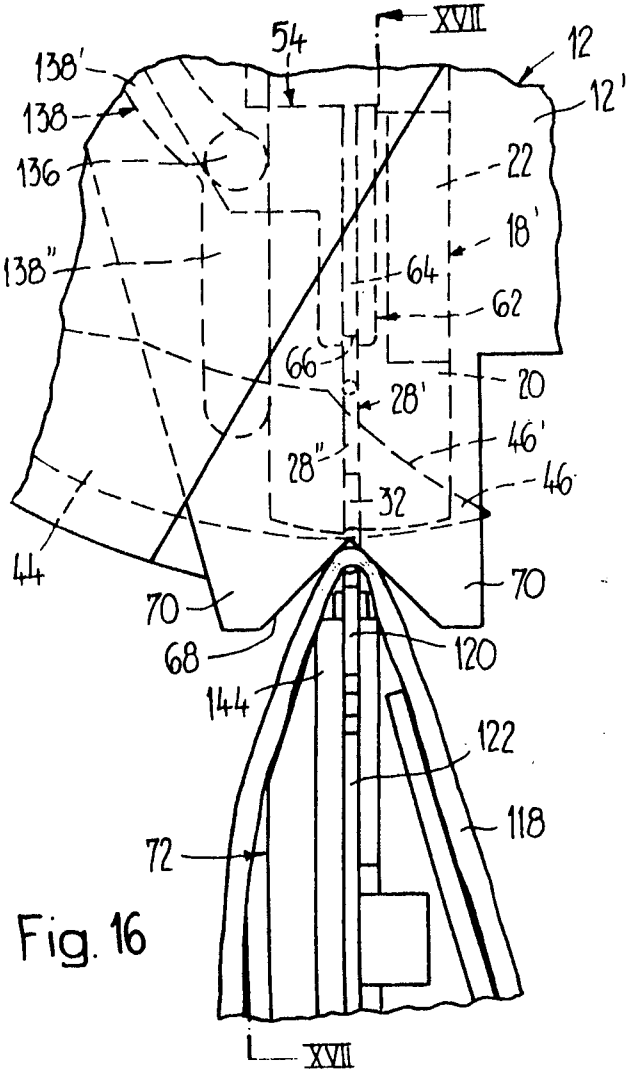

A part of the stapling head 10 represented in FIGS. 10 to 14 is represented enlarged in side view and in a vertical section in FIGS. 16 and 17. In this regard, the printed sheets to be stapled together are deposited astride a support 72 of saddle-shaped construction, for example a collector chain or collector drum. In this process, the holding noses 70 press the printed sheets 118 behind and in front of the staple 28' and laterally onto the support 72. The support 72 has, on a section 144, benders 120, these being functionally the same as the benders 120 in accordance with FIGS. 6 to 9. Neither the stamp 18 located in the staple placing position 18', nor the staple guide element 44 come to bear against the printed sheets 118. This arrangement enables these parts to be swiveled even when the stapling head 10 is lowered onto the printed sheets 118. For the sake of completeness, it should further be mentioned that the stapling head 10 according to the invention can be arranged on a tension member, preferably guided along control slotted links, or on a frame provided with the necessary control devices.

Of course, the shaft 14 can also be driven directly by means of a drive unit or of a hand-operated lever. In the embodiments shown, the stapling head 10 moves past a wire section dispenser 26, in order to accept therefrom one wire section 28 in each case. It is, however, also conceivable to arrange the wire section dispenser, for example a magazine, on the stapling head 10. In this manner, whenever the stamp 18 swivels from the rest position into the staple placing position it runs past the wire section dispenser 26 and in the process accepts one wire section 28 from the wire section dispenser 26 on each occasion in the staple acceptance position. The wire section 28 can thus be accepted from the wire section dispenser 26 in any position of the stamp 18. However, this must always be the case before the stamp 18 passes into the region of the slotted link 34 or bending slotted link 140. The staple acceptance position is always located spatially apart from the staple placing position 18' of the stamp 18.

The wire section dispenser preferably has a magazine from which the wire sections are drawn off. The magazine can be downstream of a wire cutting device, which severs the wire sections from a wire and feeds said sections to the magazine. Consequently, the wire cutting device need not be switched off each time that stapling is interrupted. It is, however, also conceivable for the wire sections to be accepted by the stapling heads directly from the wire cutting device. It is also possible to keep the wire sections ready fastened on foils or belts for drawing off by the stapling heads. A wire section dispenser is also to be understood as laying the wire sections onto the stamp by hand.

Of course, instead of the permanent magnets 30 it is also possible to provide clamping devices in order to hold the wire sections 28.

It is also possible, by an appropriate construction of the matrix and of the stamp, to form eyelets integrally on the staples. Thus, for example, it is possible to mount an attachment on the slotted link and to install a corresponding insert in the stamp, in order to form an integral eyelet-shaped bulge between the lateral arms during bending of the staples.

For the sake of completeness, it remains to be mentioned that with the construction of the stapling head 10 according to the invention it is possible for wire sections 18 of different length and thickness to be processed without undertaking adaptations or adjustments.

Stapling heads according to the invention can be advantageously employed in devices for collecting folded printed sheets, as is specified in the contemporaneous Swiss Patent Application No. 01 964/893 "Verfahren und Einrichtung zum Sammeln und Heften von gefalteten Druckbogen" and corresponding contemporaneous filed U.S. patent application Ser. No. 07/527749, "Process and Apparatus For Collecting and Stapling Folded Printed Sheets".

We claim:

1. A stapling apparatus for stapling multi-sheet print products, comprising:

a stapling head having a supporting part;

a shaft mounted on the supporting part;

a stamp movably mounted on the shaft such that the stamp is moveable from a rest position into a staple placing position and back again;

a matrix comprising a slotted link for bending an essentially straight wire section, the wire section extending approximately parallel to the axis of the shaft;

a swivelably mounted stamp configured to force the wire section against the matrix to form a staple;

a ram for ejecting the staple from the stamp when the stamp is located in the staple placing position; and wherein the stamp is configured such that a wire section from a wire section dispenser is accepted by the stamp in a wire acceptance position, the wire acceptance position being spaced from the staple placing position, and such that the stamp can be moved along the matrix to bend the wire section, the matrix arranged such that the spacing between the matrix and the axis of the shaft decreases as the stamp is moved along the matrix to bend the wire section.

2. The stapling apparatus as claimed in claim 1 wherein the stapling head is stationary relative to the print products during placing of the staple.

3. The stapling apparatus as claimed in claim 1 wherein the wire acceptance position of the stamp coincides with the rest position of the stamp.

4. The stapling apparatus as claimed in claim 1 wherein the stapling head is slidably disposed along the matrix for the purpose of bending the wire section when the stamp is stationary relative to the supporting part.

5. The stapling apparatus as claimed in claim 4 wherein the stapling head is slidably disposed along the matrix for the purpose of bending the wire section when the stamp is in the wire acceptance position.

6. The stapling apparatus according to claim 1 wherein the matrix is constructed in the form of an arc and is arranged on the stapling head such that the stapling head bends the wire section when the stamp swivels between the wire acceptance position and the staple placing position.

7. The stapling apparatus as claimed in claim 1 wherein the stamp comprises a drive nose at its free end for driving the wire section while running past the wire section dispenser, and further comprising a holding element for retaining the grasped wire section.

8. The stapling apparatus as claimed in claim 7 wherein the holding element comprises a permanent magnet.

9. The stapling apparatus as claimed in claim 1 wherein the stapling head includes a staple guide element for guiding the staple during the ejection from the stamp.

10. The stapling apparatus as claimed in claim 9 wherein:

the stamp includes a cutout wherein the staple is held:

the staple guide element, in the staple placing position of the stamp, engages the cutout in the stamp; and the staple guide element is mounted swivelably on the shaft, and can be brought out of engagement with the cutout during ejection of the staple by the ram.

11. The stapling apparatus as claimed in claim 6 wherein the matrix is disposed on the staple guide element.

12. The stapling apparatus as claimed in claim 10 wherein the matrix is disposed on the staple guide element.

13. The stapling apparatus as claimed in claim 1 wherein the stapling head includes a holding arrangement projecting towards the print products relative to the stamp in the staple placing position thereof, such that the print products are forced against a support during placing of the staple.

14. The stapling apparatus as claimed in claim 13 wherein:

the holding arrangement includes two holding elements, the holding elements being mutually spaced in the direction of the axis;

in the staple placing position, the stamp is arranged between the holding elements; and each holding element includes two holding noses mutually separated by an approximately V-shaped cutout such that the print products are forced laterally against the support on both sides of the staple.

15. The stapling apparatus as claimed in claim 1 wherein:

the shaft is driveable;

the stamp is seated firmly rotationally on the shaft; and the ram can be actuated by means of a drive member independent of the shaft to eject the staple from the stamp.

16. The stapling apparatus as claimed in claim 15 wherein the drive member comprises a slotted link.

17. The stapling apparatus as claimed in claim 1 comprising a joining drive arrangement for swiveling the stamp and driving the ram.

18. The stapling apparatus as claimed in claim 17 wherein the ram is slidably guided in the radial direction of the stamp, and further comprising a control arrangement for controlling movement of the ram, the control arrangement provided on the stapling head, wherein the control arrangement is dependent upon the swivel angle of the stamp.

19. The stapling apparatus as claimed in claim 18 wherein:

the stamp is rotatably seated on the shaft;

the shaft is constructed to be driveable;

a toothed rack which is integrally formed on the ram and effective in the sliding direction thereof;

the shaft includes a pinion that meshes with the toothed rack; and the control arrangement includes a cam path, wherein the cam path acts on the ram and facilitates rolling down of the toothed rack on the pinion exclusively in the region of the staple placing position.

* * * * *

UNITED STATES PATENT AND TRADEMARK OFFICE

CERTIFICATE OF CORRECTION

PATENT NO. : 5,098,002

DATED : March 24, 1992

INVENTOR(S) : Hänsch Et Al.

It is certified that error appears in the above-indentified patent and that said Letters Patent is hereby corrected as shown below:

ON THE TITLE PAGE item [30] "Foreign Application Priority Data"

after "01963", please insert --/89-1--.

In column 3, line 59, after "12", please insert --'--.

In column 7, line 57, please delete "against" and substitute therefor --again--.

In column 8, line 2, please delete "against" and substitute therefor --again--.

Signed and Sealed this

Third Day of May, 1994

Bruce Lehman

*Attest:*

BRUCE LEHMAN

*Attesting Officer*

*Commissioner of Patents and Trademarks*